US005547253A

United States Patent [19]

Schwartz et al.

[11] Patent Number: 5,547,253

[45] Date of Patent: Aug. 20, 1996

[54] SIT/STAND ADJUSTABLE, TOWER CHAIR

[76] Inventors: Edward M. Schwartz, deceased, late of Bedford Hills, N.Y.; by Nancy L. Schwartz, administratrix, 9 Nottingham Rd., Bedford Hills, N.Y. 10507

[21] Appl. No.: 288,911

[22] Filed: Aug. 11, 1994

[51] Int. Cl.[6] ..... A47C 3/20

[52] U.S. Cl. ..... 297/338; 297/411.36; 297/411.40; 297/452.21; 297/452.29; 5/935

[58] Field of Search ..... 297/423.38, 353, 297/338, 344.19, 344.18, 411.36, 411.40, 452.21, 452.29, 284.1, 452.41; 248/121, 122, 125; 5/937, 935, 465

[56] References Cited

U.S. PATENT DOCUMENTS

| | | | |
|---|---|---|---|
| 1,261,396 | 4/1918 | Jackman | 297/344.18 |
| 2,546,460 | 1/1951 | Leeds | 248/122 |
| 2,637,371 | 5/1953 | Boutin | 297/344.18 |
| 3,221,349 | 12/1965 | Bradley | 5/937 |
| 3,256,036 | 6/1966 | Nolan | 297/344.19 |
| 3,261,034 | 7/1966 | Bradley | 5/937 |
| 3,286,970 | 11/1966 | Nolan | 297/344.19 |
| 3,499,682 | 3/1970 | Orenstein | 297/452.41 |
| 4,466,665 | 8/1984 | Aronowitz et al. | 297/411.41 |
| 4,514,010 | 4/1985 | Sabater Gonzalez | 295/452.41 |
| 4,738,487 | 4/1988 | Shalinsky et al. | 297/338 |
| 4,761,011 | 8/1988 | Sereboff | 297/452.41 |
| 4,768,831 | 9/1988 | Liedberg et al. | 297/344.19 |
| 5,113,540 | 5/1992 | Sereboff | 297/452.41 |

FOREIGN PATENT DOCUMENTS

| | | | |
|---|---|---|---|
| 1541071 | 2/1979 | United Kingdom | 297/452.41 |

OTHER PUBLICATIONS

Advertisement entitled "Ergoform Workseat" relating to tilting seat described in U.S. Pat. No. 4,738,487.

*Facilities Design & Management,* "Product & Services, Market Spotlight: Task Chairs", pp. 61–64, Jul. 1993.

Article in Wall Street Journal d Article in Wall Street Journal dated May 2, 1994, "Sitting Smarter At The Office".

*Primary Examiner*—Peter M. Cuomo
*Assistant Examiner*—Anthony D. Barfield
*Attorney, Agent, or Firm*—Sughrue, Mion, Zinn, Macpeak & Seas

[57] ABSTRACT

An adjustable, tower chair includes a five spoke rolling base having a central portion; and a tower including a lower portion mounted to the central portion of the base, and an upper portion extending upwardly with respect to the lower portion and off-center with respect to the central portion of the base. A seat, a back support, a footrest and a U-shaped armrest are all adjustably mounted to the upper portion of the tower for movement up and down thereon, such that each can be adjusted to the optimum height for a given user.

18 Claims, 10 Drawing Sheets

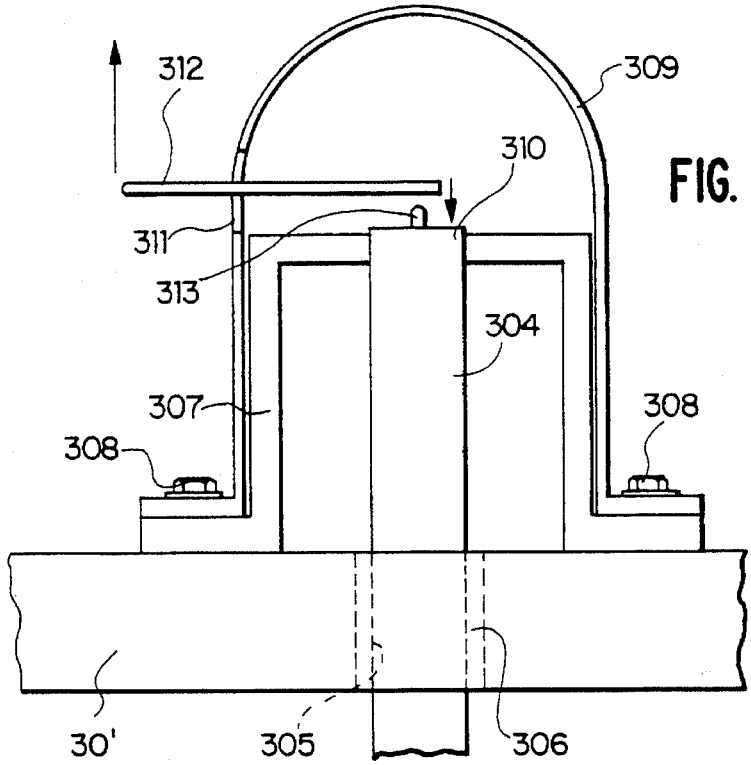
FIG. 18
FIG. 11
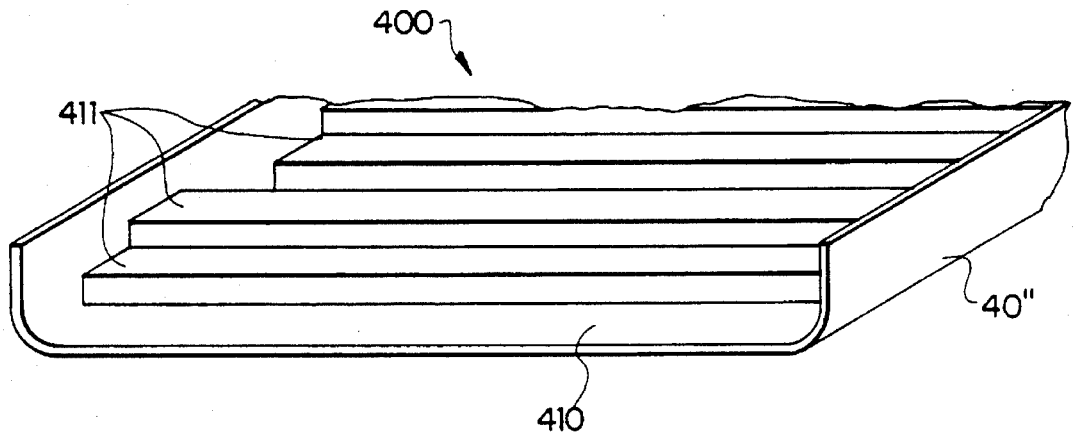

SIT/STAND ADJUSTABLE, TOWER CHAIR

BACKGROUND OF THE INVENTION

1. Field of the Invention

My invention provides a sit/stand adjustable, tower chair which is constructed so as to allow the footrest, the seat, the armrests and the back support to be vertically adjustable up and down, as well as to allow back-and-forth movement in a horizontal direction. More specifically, a tower is mounted to a base portion in an off-center manner and extends generally vertically therefrom. Each of the footrest, the seat, the armrests and the back support is adjustably mounted with respect to the off-center tower.

2. Description of the Related Art

There are at least 10 million video display terminals (hereinafter referred to as "VDTs") in use across the country, and it is predicted that there will be greater than 40 million VDTs by the end of this century. While VDTs are used for a variety of tasks, they are used most intensively by a range of office workers who may spend the entire day keypunching and processing information.

However, as the number of VDTs in the work place has risen, so have the health complaints associated with their use. Surveys indicate the majority of full-time VDT users report high frequencies of health problems. Among other problems, recent studies confirm that VDT users have higher incidences of problems such as eye strain, headaches, insomnia, back and neck strain and fatigue.

As these health concerns have been recognized as legitimate and serious, steps are being taken in many states to introduce legislation to institute health and safety protections for VDT users.

In addition to providing adjustable work stations, including an adjustable work surface, adjustable keyboard, adjustable wrist support and adjustable VDT unit, another important variable is the provision for an ergonomically designed office chair. Such a chair must not only be easily adjustable and functional for the VDT user or office worker in general, but must likewise be aesthetically pleasing so as to be practical in today's high tech, electronic offices.

U.S. Pat. No. 4,738,487 (Shalinsky et al.) discloses a tilting seat having a base for supporting the seat on the floor and a stem extending upwardly from the base, either integrally or separably from the base, the seat being arranged such that it tilts about a tilting axis passing through the base such that the user can tilt the seat forward when in a working position.

In one embodiment of the '487 patent, the stem is integral with the base and forms an acute angle therewith, with the forward part of the base being rounded. Accordingly, the seat will tilt about the axis defined by the rounded forward surface so as to move the center of gravity of the user to a position where the buttocks support is well ahead of the vertical plane containing the axis of tilting. In another embodiment, the '487 patent discloses a stem which is pivotally mounted to the base which takes the form of a turntable.

While the '487 patent allows for the user to tilt the seat forward when in a working position, and the buttocks support is adjustable in height relative to the stem, the buttocks support height adjustment is limited due to the slant of the stem with respect to the base. Also, the '487 patent tilting seat does not provide for an adjustable back support, footrest, armrest or the option of a gas cylinder including a gas cylinder which is mounted on a height adjustable base.

SUMMARY OF THE INVENTION

It is an object of the present invention to provide an adjustable chair which provides for adjustment of a seat, footrest, armrests and back support in both the height direction and the horizontal direction all with respect to a single generally vertical tower which in turn is mounted to a base.

It is a further object of the present invention to provide a chair which is not only movably adjustable but is aesthetically pleasing and retains a more conventional appearance.

It is still a further object of the present invention to provide a chair including a seat and a back support each of which includes a silicone gel filled pad including means for pinching the silicone pad from the exterior thereof to create restrictions or baffles to regulate the flow throughout the silicone gel filled pad.

More specifically, the present invention relates to an adjustable chair comprising a base including a central portion; a tower including a lower portion mounted to the central portion of the base, and an upper portion extending upwardly with respect to the lower portion and off-center with respect to the central portion of the base; and a seat disposed on the upper portion of the tower and including a seat height adjustment means for movably adjusting the seat up and down on the tower.

The adjustable chair may further comprise a back support disposed on the upper portion of the tower and including a back support height adjustment means for movably adjusting the back support up and down on the tower; a footrest disposed on the upper portion of the tower and including footrest height adjustment means for movably adjusting the footrest up and down on the tower; and a U-shaped armrest bar disposed on the upper portion of the tower and including armrest height adjustment means for movably adjusting the armrest bar up and down on the tower.

The seat and back support each may include a mechanism for permitting back and forth movement thereof with respect to the tower, as well as pivotable movement.

The footrest may include a telescopic connection to permit back and forth movement of the footrest relative to the tower. Likewise, arm pads may be slidably mounted on each of the free ends of the U-shaped armrest bar for back and forth movement with respect thereto.

According to a further embodiment, a gas cylinder is mounted on an adjustable base, such that the seat of the chair is infinitely adjustable in height in a vertical range from as low as 12" from the floor to a stool height of, for example, 32".

BRIEF DESCRIPTION OF THE DRAWINGS

Other features and advantages of the present invention will be apparent from the following description taken in connection with the accompanying drawings, wherein:

(FIG. 4 shows smooth, curved lines as in FIG. 3);

FIG. 11 is a perspective view of a further alternative of the pinching means including a stepped inner surface of the seat pan;

FIG. 18 is a detailed elevational view of the upper portion of the gas cylinder and the rigid cap for fixing the same to the rail 30.

DETAILED DESCRIPTION OF THE PREFERRED EMBODIMENTS

The invention will now be described with reference to the drawings.

Figure 1:
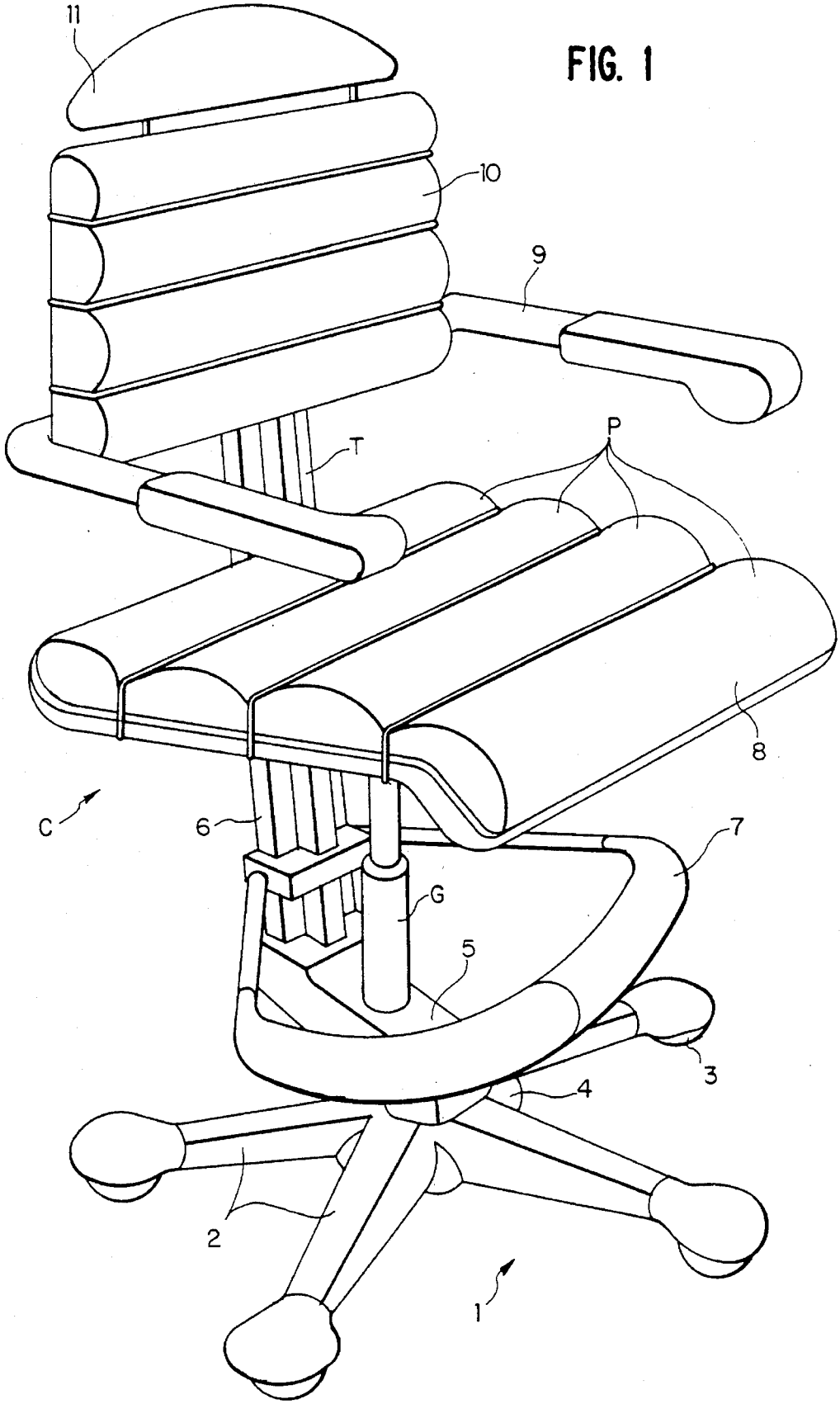
FIG. 1 is a perspective view of the adjustable, tower chair according to a first embodiment of the present invention.

In FIG. 1, a perspective view of the adjustable, tower chair C is shown. The base 1 may take the form of a five spoke rolling base including spokes 2 having rollers 3 rotatably mounted at the ends thereof and a central portion 4. Clearly, a base having a different number of spokes or being stationary could likewise be employed. For example, a stationary flat plate could be used as the base, although this would restrict the easy maneuverability of the chair especially with a user seated therein.

Figure 7:
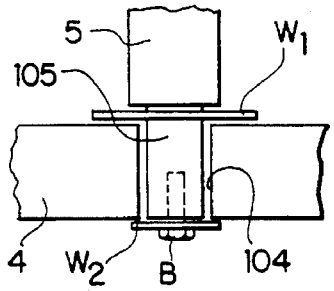
FIG. 7 is a close-up view of the pivotal connection between the tower and the base according to the present invention.

A tower T having a lower portion 5 and an upper portion 6 is fixed to the base 1. In particular, the lower portion 5 of the tower T is a lazy S-shaped member having one downwardly facing end fixed to the central portion 4 of the base 1 and the opposite upwardly facing end connected to the lower end of the upper portion 6 of the tower T by suitable fastening means F (see FIG. 5). The lower portion 5 of the tower T may be rotatably mounted to the central portion 4 of the base 1 so as to allow the tower T and everything mounted thereon to swivel 360° about the base 1. For example, the lower portion 5 of the tower T may be formed with a stem 105 which is rotatably fitted in a through-hole 104 at the central portion 4 of base 1. A threaded bolt B is threadedly engaged in a bore in the end of the stem 105 which protrudes through the through-hole 104 in the base 1. Frictionless plastic washers $W_1$ and $W_2$ are respectively sandwiched between the lower portion 5 of the tower T and the top of base 1 as well as the underside of the base 1 and the bolt B (See FIG. 7).

Figure 2:
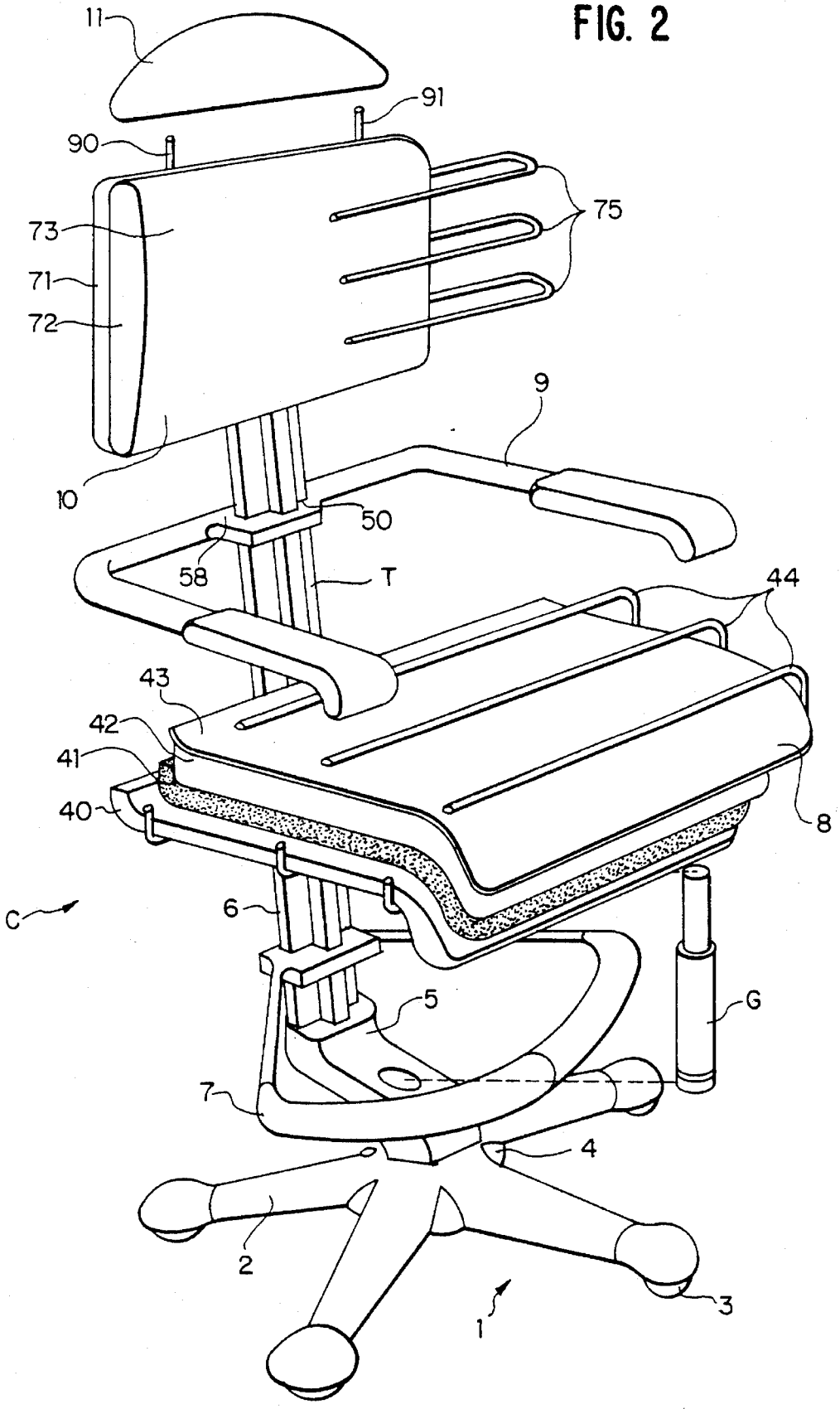
FIG. 2 is a perspective view which is partially exploded in order to show details of the adjustable, tower chair according to the present invention.
Figure 5:
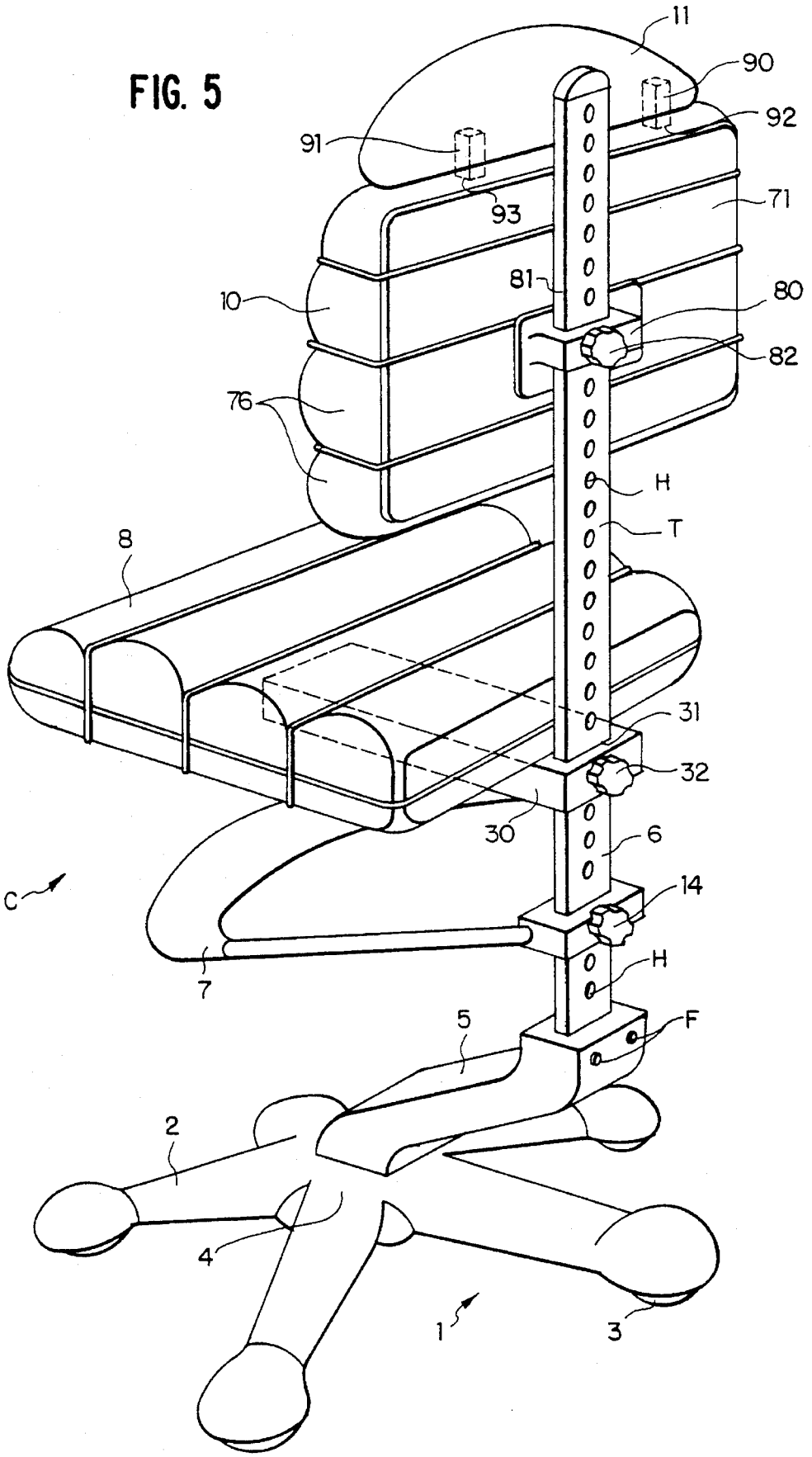
FIG. 5 is a perspective, rear view of the adjustable, tower chair (armrest omitted) according to a first embodiment of the present invention.

Further, as seen in FIGS. 1, 2 and 5, the upper portion 6 of the tower T extends upwardly off-center from the central portion 4 of the base 1. While the upper portion 6 of the tower T extends upwardly in a generally vertical direction, it may extend upwardly at a slight angle with respect to a vertical axis.

As will be discussed in detail below, a footrest 7, a seat 8, a U-shaped armrest 9, and a back support 10 having an upper cushion portion 11 attached thereto are all adjustably mounted to the upper portion 6 of the tower T for slidable movement up and down thereon, such that each can be adjusted to the optimum height for a given user and locked into that position.

As shown in FIGS. 1 and 2, an optional, conventional gas cylinder G may be positioned between an underside of the seat 8 and the lower portion 5 of the tower T for added stability.

With such a configuration, the upper portion 6 of the tower T is mounted to the base 1 in an off-center manner and extends generally vertically therefrom, so that each of the footrest 7, the seat 8, the armrest 9, and the back support 10 is adjustably mounted with respect to the off-center tower T.

The detailed construction and operation of each one of the footrest, the seat, the armrest, and the back support will now be described.

Figure 3:
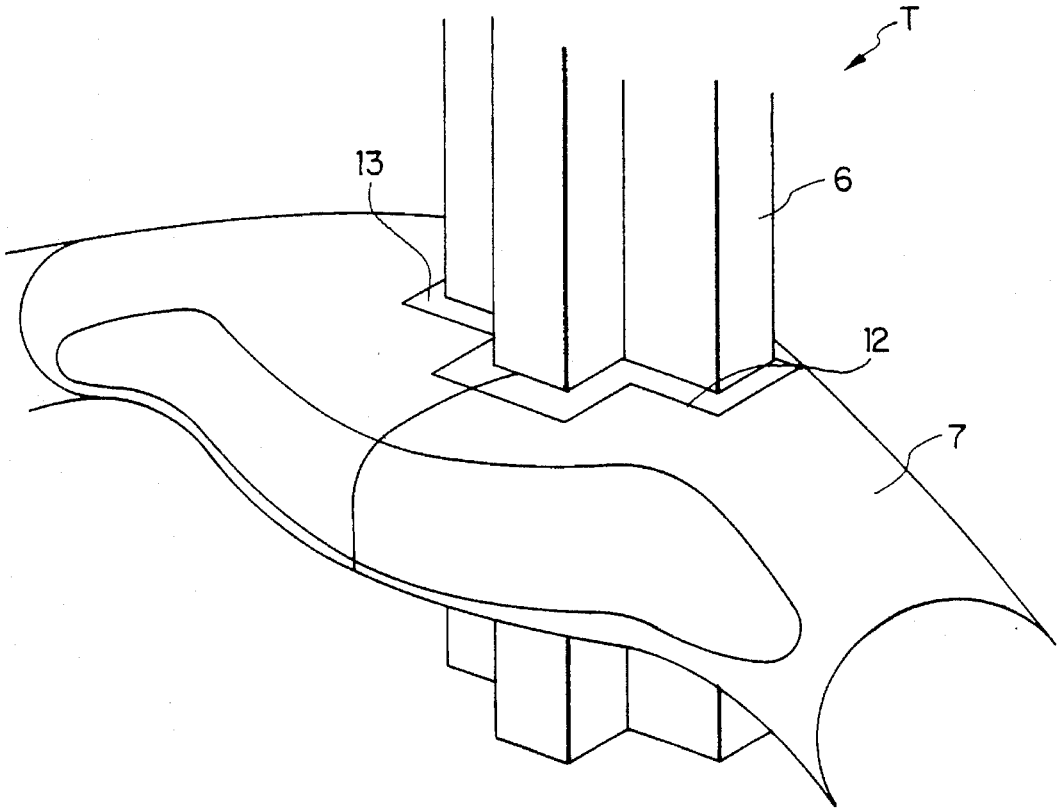
FIG. 3 is an enlarged fragmentary view of the connection between the footrest and the tower as viewed from the front according to a first embodiment of the present invention, but having smooth, curved lines for a stylistic effect.
Figure 4:
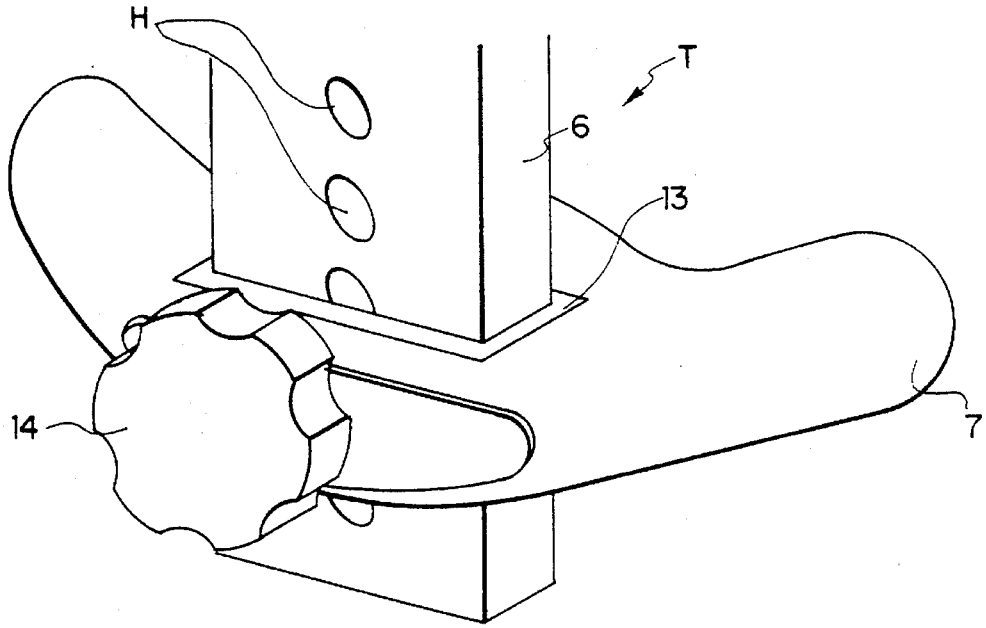
FIG. 4 is an enlarged fragmentary view of the connection between the footrest and the tower as viewed from the rear according to a first embodiment of the present invention

FIGS. 3 and 4 show enlarged fragmentary views of the connection between the footrest 7 and the upper portion 6 of the tower T from the front and rear, respectively, of the chair C. FIGS. 3 and 4 show the footrest having smooth, curved lines at the block portion which surrounds the tower for a stylistic effect, as compared to the more rectangular shape shown in FIGS. 1, 2 and 5. As shown in FIG. 3, the upper portion 6 of the tower T has a generally T-shaped cross-section. Although the cross-sectional shape of the tower is not limited to this shape, this shape gives added stability to the footrest 7, as well as the seat 8, armrest 9, and back support 10. The footrest 7 includes a footrest height adjustment means comprising an opening 12 having a complementary shape to the tower T and for slidably fitting over the tower. A low friction insert 13 is disposed within the opening 12 to provide for easy slidable motion up and down along the tower T. The footrest height adjustment means further includes an actuator handle or knob 14 for a locking mechanism and which is positioned at the rear of the footrest 7 and is operative to lock the footrest into position once the footrest has been slid up or down along the upper portion 6 of the tower T and positioned at the desired height.

Figure 16:
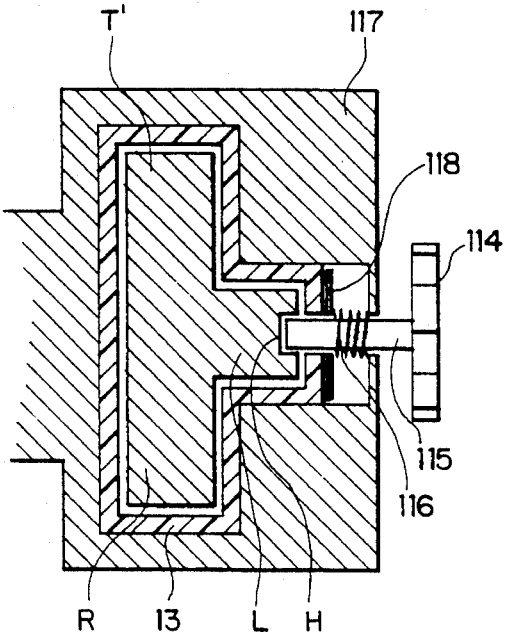
FIG. 16 is a fragmentary cross-sectional view through the tower and one type of locking mechanism to be used for locking any one of the footrest, seat, armrests, back support, or adjustable base for the gas cylinder in the desired position.
Figure 17:
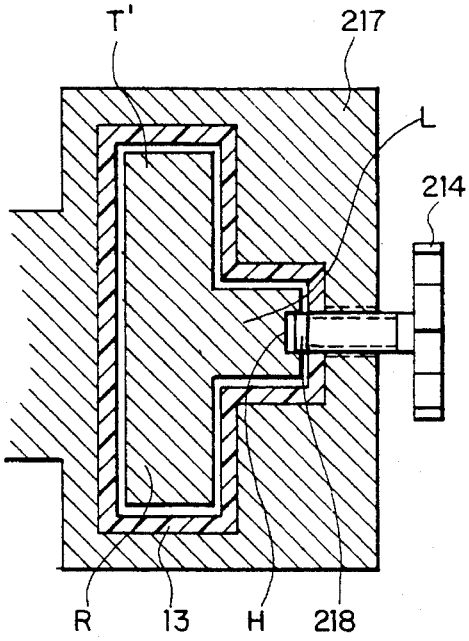
FIG. 17 is a fragmentary cross-sectional view through the tower and an alternative locking mechanism.

The locking mechanism can take a number of various forms. For example, the tower T may include a plurality of equidistantly spaced bores or holes H positioned at increments of 0.5 inches and disposed in vertical alignment with each other up and down the back of the tower, as shown in FIGS. 4 and 5. The actuator handle 14 can be a spring-biased, pull-out type handle or a threaded turning type handle. In this regard, FIGS. 16 and 17 show the two above-noted type actuator handles used in conjunction with the tower T' of the second embodiment. Note that in the second embodiment the tower T' cross-section is just the reverse of the first embodiment so that the leg portion L faces away from the chair, as will be discussed in more detail below. The actuator handle or knob operates the same regardless of the orientation of the tower. As shown in FIG. 16, the pull-out type handle 114 includes a shank portion 115 having a coiled compression spring 116 fitted thereover. The spring 116 is compressed between the block housing 117 and a stopper 118 attached near the free end of the shank. The spring 116 normally biases the shank 115 toward the tower (T, T') so that the end portion of the shank is fitted into the hole or bore H of the tower T, T' at the desired height. The length of the shank which protrudes into the hole or bore H is chosen based on the amount of force which will be applied during normal use of the chair.

As shown in FIG. 17, the threaded turn-type handle 214 simply is threadedly engaged with the block housing 217. An end portion 218 of the shank 215 is unthreaded so that when the handle is turned in one direction, the unthreaded portion of the shank 215 is inserted into the hole or bore H of the tower T, T' and vice versa.

Figure 6:
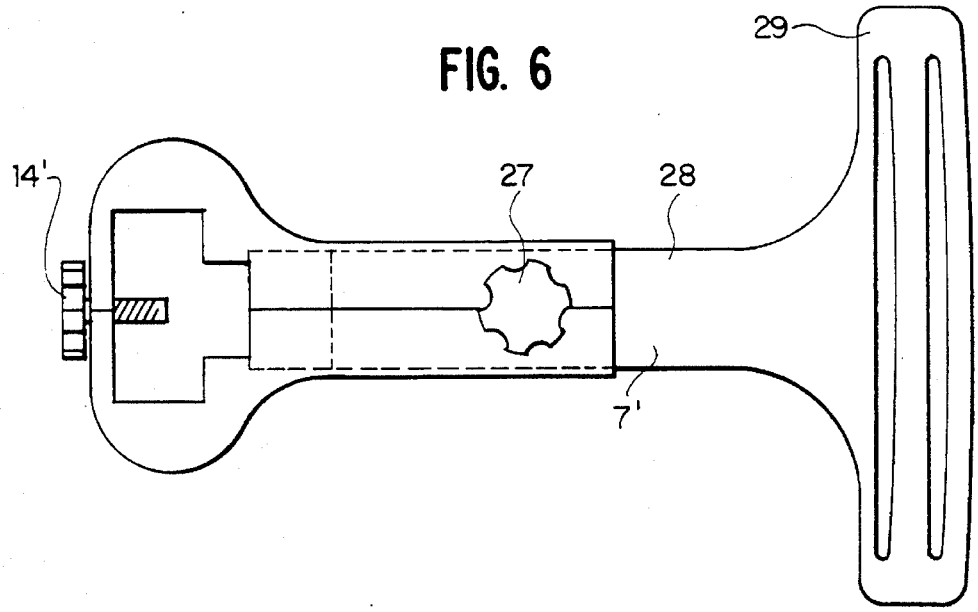
FIG. 6 is a top view showing a telescopically adjustable embodiment of the footrest according to the present invention.

As best shown in FIG. 6, the footrest may also be horizontally adjustable. In particular, FIG. 6 shows an alternative footrest design 7' wherein only a single arm 28 extends out to the footrest portion 29 which is perpendicular to the arm 28. The arm 28 may be formed as a telescopic member, so that the footrest is slidable back and forth in a substantially horizontal direction. A locking knob 27 is included for locking the footrest 7' in the desired position.

As best shown in FIGS. 5 (schematically only) and 8A, the seat 8 is mounted on a rail 30. The rail 30 includes a seat height adjustment means comprising an opening 31 having a complementary shape to the tower T for slidably fitting over the tower. A low friction insert (not shown) is disposed within the opening 31 to provide for easy slidable motion up and down along the tower T just as in the footrest 7, as described above. The seat height adjusting means further includes an actuator handle 32 which is provided for operating a locking mechanism in an identical manner to that described above with respect to the footrest. The actuator handle 32 is located at the rear of the rail 30 as seen in FIG. 5. When a user turns the actuator handle 32 to thereby unlock the locking mechanism, the seat 8 is slidably movable up or down along the upper portion 6 of the tower T and may be positioned at the desired height. Once at the desired height location, the user can simply turn the handle to lock the rail 30 in place.

Figure 8A:
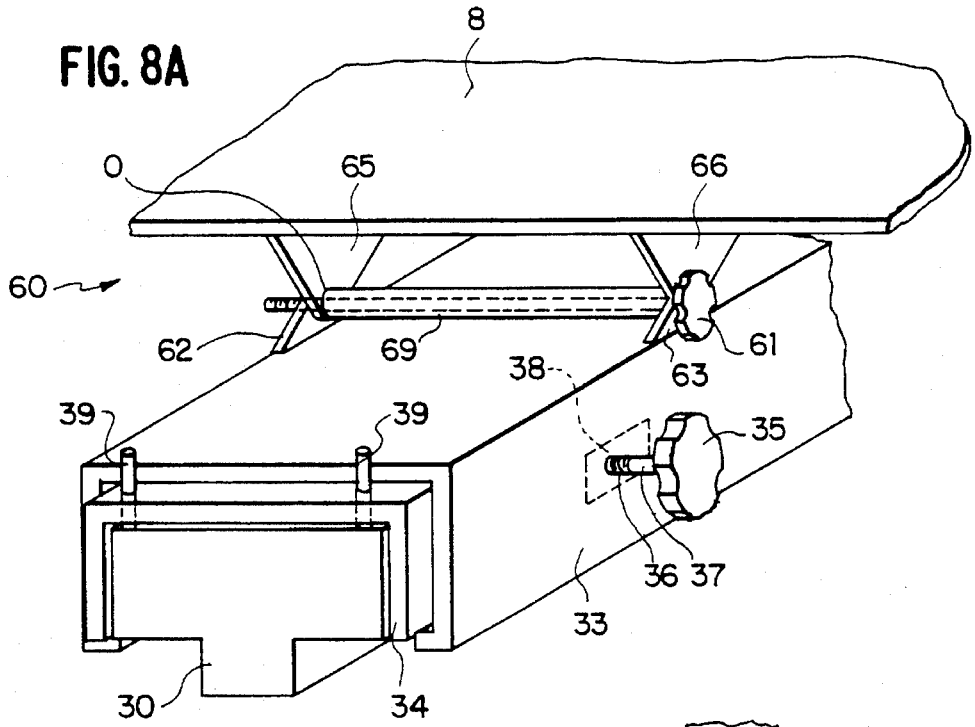
FIG. 8A is a detailed perspective view of the mechanism for permitting the seat to move back and forth and tilt.

The seat 8 is also mounted for slidable movement back and forth on the rail 30. As best seen in FIG. 8A, a slidable track or carriage 33 is mounted to the underside of the seat 8. The slidable track 33 is C-shaped and is slidably mounted on the stationary rail 30. The rail 30 may be T-shaped in cross-section for added strength. A TEFLON bearing sleeve 34 is mounted on top of the rail 30 to provide a frictionless surface for the slidable track 33 to ride on. A threaded locking handle 35 is threadedly engaged in a hole 36 formed on the side of the slidable track 33 to permit the user to lock the track 33 into position by turning the handle 35 until the end of the shank 37 engages the TEFLON bearing sleeve 34, or more preferably a metal wear plate 38 disposed on the side of the TEFLON bearing sleeve 34.

Figure 8B:
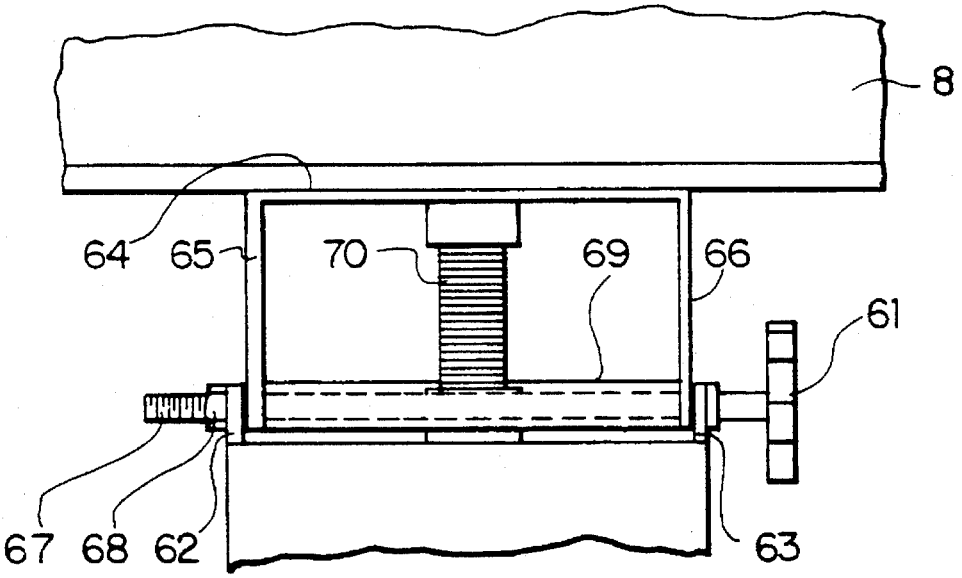
FIG. 8B is a front elevational view of the mechanism for permitting the seat to move back and forth and tilt.
Figure 8C:
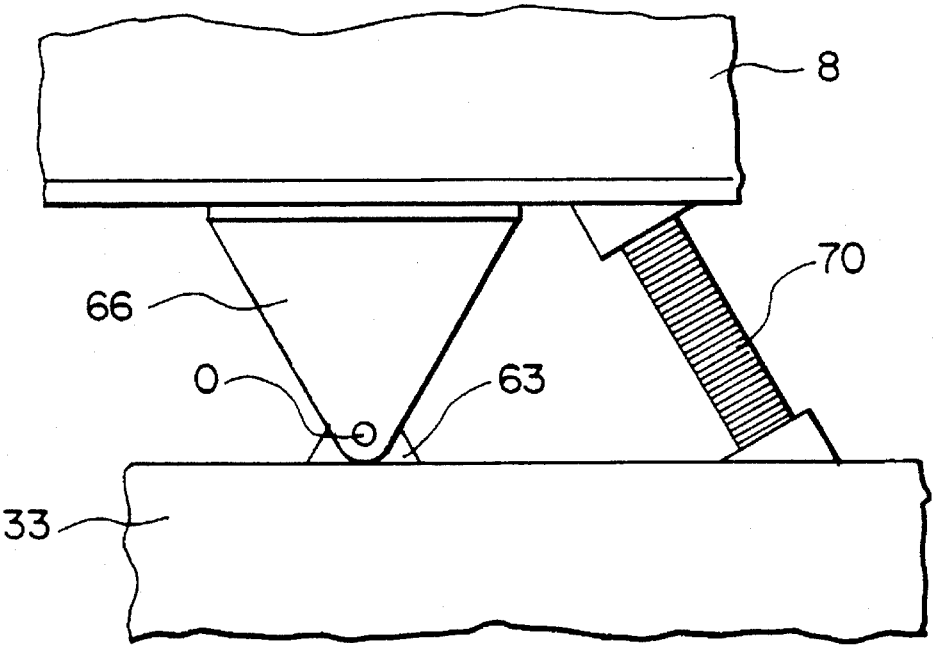
FIG. 8C is a side elevational view of the mechanism for permitting the seat to move back and forth and tilt.

The seat 8 is pivotally mounted on the slidable track 33 by a pivot assembly 60 and is lockable into a desired pivot position by a friction handle 61. More specifically, triangular shaped plates 62 and 63 extend vertically from either side of the track 33 and have openings therein which are aligned with each other. As best shown in FIGS. 8B and 8C, the bottom of the seat 8 has a metal plate-like member 64 which is an inverted U-shape in cross section and includes downwardly extending triangular shaped plates 65 and 66 which are similar to those extending from the track 33 and which extend down so as to fit within the plates 62 and 63 of the slidable track 33. The downwardly extending plates 65 and 66 of the inverted U-shaped member 64 likewise include openings which are aligned with the openings in the plates 62 and 63. With all of the openings O in alignment, a suitable bolt 67 is passed therethrough having threaded portions at either end thereof. A lock washer (not shown) and a nut 68 may be fastened at one end of the bolt 67 which protrudes out beyond one of the plates. The handle 61 has an internally threaded hole and is screwed on the other end of the bolt 67. The portion of the bolt passing through the aligned plates is unthreaded. A washer is positioned between the handle 61 and the corresponding plate 63. When assembling the pivot assembly, a hollow tubular member 69 is inserted between the downwardly extending plates 65 and 66 of the inverted U-shaped member 64 of the seat 8 and is positioned in alignment with the holes O. The bolt 67 is then slid through the aligned holes O and also through the hollow tubular member 69. The hollow tubular member 69 permits the tightening friction of the handle 61 to be directed to the opposite plate members 62, 65 so as to lock the seat in a desired pivot position.

A spring 70, which is disposed at, for example, a 45° angle, is connected between the bottom of the seat 8 and the slidable track or carriage 33, just behind the pivot assembly 60. The spring 70 may take the form of a stiff coiled spring and serves to return the seat to a horizontal position when no force is applied to the seat as by a user.

A pair of vertically upstanding safety stops 39 are positioned at the front and back of the rail 30 so as to prevent the slidable track or carriage 33 from sliding off the rail 30.

As best seen in FIG. 2, the construction of the seat 8 per se comprises a pan 40 formed of metal or a synthetic resin and which serves as a rigid support, a foam member 41 which rests on top of the pan 40, a silicone gel filled pad 42 which lies on top of the foam member 41, an upholstery cover 43 which covers over the various layers, and a plurality of barrette clips 44. The barrette clips 44 are spaced apart a desired distance along the seat 8 and when fastened into position divide the seat into a plurality of pillows P, as best seen in FIG. 1. While four pillows P are shown in FIG. 1, clearly the number of barrettes 44 can be greater or lesser in order to increase or decrease the number of pillows.

Figure 9:
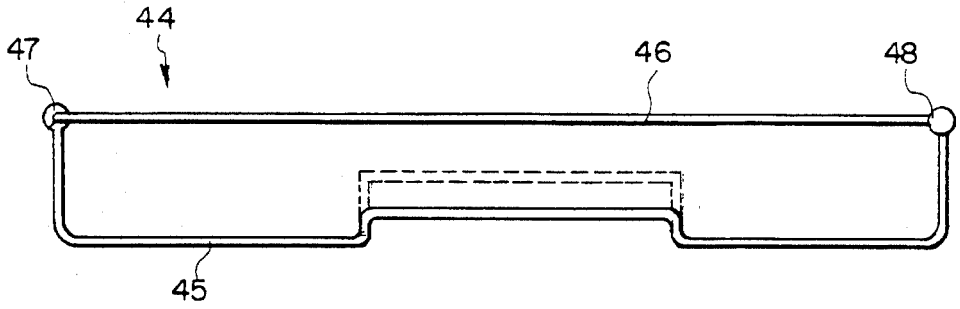
FIG. 9 is a detailed side view of one of the seat barrette clips.

As shown in FIG. 9, each of the barrette clips 44 includes a lower portion 45 which fits underneath the seat 8 and an upper movable portion 46 which is hinged at one end as at 47 and has a free end 48 which engages with the lower portion 45 when in the closed position. Once the barrette clip 44 is positioned over the seat and closed tight, the barrette clip serves as pinching means for pinching the seat cover 43 along with the silicone gel filled pad 42 so as to form an indentation in the seat 8 and in turn serve as a baffle within the interior of the silicone filled gel pad 42. Accordingly, as the user's weight is shifted on the seat 8, the flow of silicone gel past the internal baffles formed by the barrette clips is restricted so as to slowly adjust to the weight distribution of the user. The pad 42 is not limited to silicone gel as the filling material and other fluids such as air may be used instead. Also, the barrette clips 44 can be formed so as to be adjustable in height.

Figure 10:
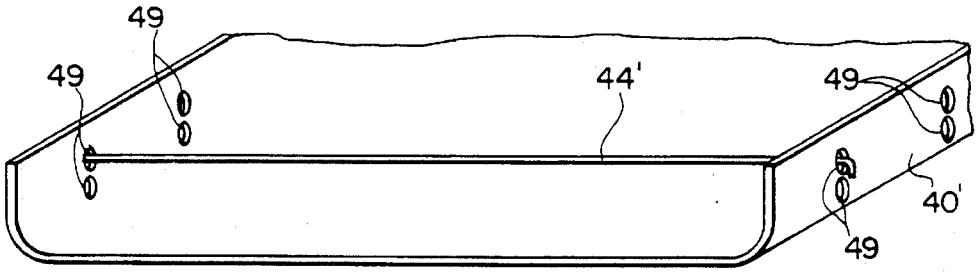
FIG. 10 is a perspective view of the seat pan and an alternative barrette clip.

FIG. 10 shows an alternative form of the clip 44' wherein the seat pan 40' includes opposing through-holes 49, 49 at different heights in the upturned side portions thereof. The clip 44' comprises a rod which is slipped through the holes 49, 49 and held in place thereby so as to form the indentation in the upholstery cover and silicone gel pad. By placing a rod 44' in a lower set of holes 49, 49, the flow of silicone gel will be further restricted between pillows.

FIG. 11 shows a still further embodiment of the pinching means for pinching the silicone gel filled pad 42. However, the embodiment of FIG. 11 dispenses with external pinching means for pinching an outer surface of the seat such as the barrette clip 44 or the rod 44' and instead utilizes a stepped or contoured surface 400 formed in the inner or upper surface 410 of the seat pan 40". In particular, the seat pan 40" which is formed of metal or a rigid synthetic resin, is formed with a stepped surface 400 such that bars 411 of various heights extend upwardly from the seat pan 40". The silicone gel filled pad 42 is then simply placed on top of the stepped surface 400 so that the bars 411 of various heights project into the underside of the silicone gel filled pad 42. Accordingly, when a user sits on the seat, or leans back on the back support, the user's weight causes the flow of silicone gel past the internal baffles formed by the varying height bars 411 thereby slowly adjusting the weight distribution of the user, especially during forward and backward movement of the user, as well as the sitting-down shock of the user. Of course, the configuration of the stepped surface 400 is not limited to that shown in the drawing and may take on other suitable configurations which accomplish the goal of compensating for forward, backward, and sitting-down shock of the user.

While several embodiments have been shown and discussed with respect to the pinching means, other suitable means could be employed such as, for example, rubber bands in order to form internal baffles to restrict the flow of silicone gel.

Moreover, while the pinching means is shown in connection with an office-type chair, it is not limited to such and may be employed with, for example, a car seat/back or other seat/back units.

As best seen in the exploded view of FIG. 2, the armrest 9 is a U-shaped bar which includes an armrest height adjustment means comprising an opening 50 having a complementary shape to the tower T for slidably fitting over the tower. Again, a low friction insert (not shown) similar to the one used with the footrest 7 is disposed within the opening 50 to provide for easy slidable motion up and down along the tower T. The armrest height adjustment means further includes an actuator handle or knob 51 (see FIG. 12A) which is positioned at the rear of the armrest 9 and is operative to lock the armrest into position once the armrest has been slid up or down along the upper portion 6 of the tower T and positioned at the desired height.

Figure 12A:
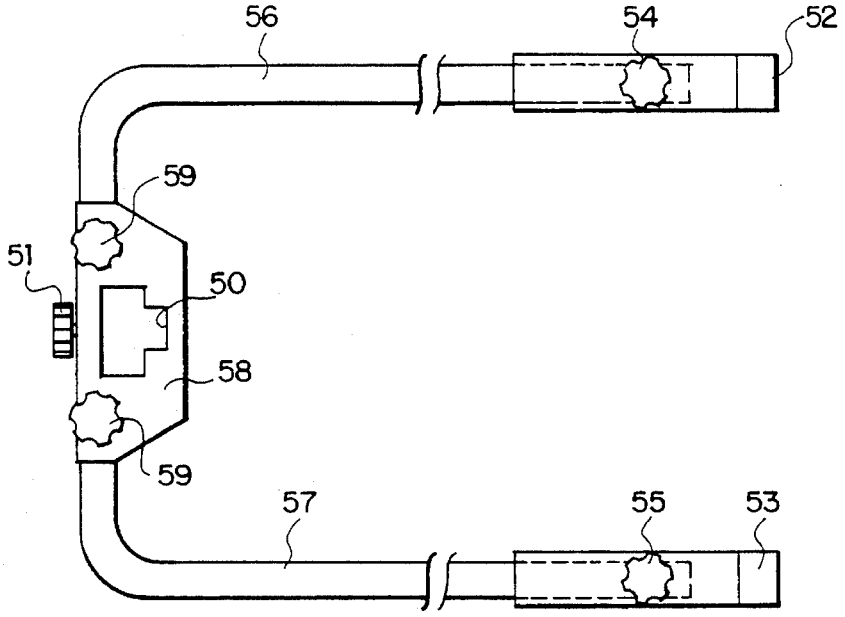
FIG. 12A is a top view of the armrest bar.

As shown in FIG. 12A, each of the arm pads 52 and 53 is telescopically mounted on the U-shaped bar of the armrest 9 for back and forth movement. Further, each of the arm pads 52, 53 includes a respective locking knob 54 and 55 underneath for locking the arm pads in the desired position along the U-shaped bar. Other suitable locking means such as a conventional rocker lock could also be employed to lock the arm pads.

Figure 12B:
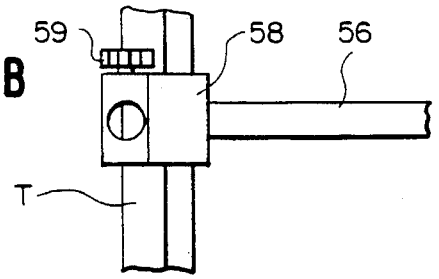
FIG. 12B is a side elevational view of the tower and showing one of the armrest connections.

In addition, while the U-shaped armrest bar is shown as rigid with the base 58 in FIG. 2, the portions 56 and 57 of the U-shaped armrest bar may be rotatably mounted within the base 58 of the U-shaped bar (see FIGS. 12A and 12B) and lockable into position such that the armrest may be pivoted upwardly so as to be positioned out of the way, or pivoted downwardly into an operative position and locked into place by locking knobs 59, 59.

As best seen in FIG. 5, the back support 10 includes a support portion 80 including a back support height adjustment means comprising an opening 81 having a complementary shape to the tower T and for slidably fitting over the tower. Again, a low friction insert (not shown) may be disposed within the opening 81 to provide for easy slidable motion up and down along the tower T. The back support height adjustment means further includes an actuator handle or knob 82 which is provided for operating a locking mechanism which operates in an identical manner to the locking mechanism of the footrest 7. Accordingly, upon turning the actuator handle 82 so as to position the locking mechanism in the unlocked position, the back support 10 is slidable up or down along the upper portion 6 of the tower T and positioned at the desired height for the user, and then is locked into position by again turning or pushing the actuator handle 82 to cause the shank to enter the corresponding hole H so as to engage the tower T.

The back support 10 per se is constructed in a manner similar to the seat 8 and includes a metal or synthetic resin back plate 71, a foam piece (not shown), a silicone gel filled pad 72 and an upholstery cover 73 (see FIG. 2). Again, a plurality of barrette clips 75, which are similar to the barrette clips 44 of the seat 8, are positioned along the back support 10 and fastened into position so as to divide the back support 10 into a plurality of pillow portions 76. The barrette clips 75 are constructed and operate in a manner similar to the barrette clips 44 of the seat and therefore, for the sake of brevity, will not be described in detail.

Figure 13A:
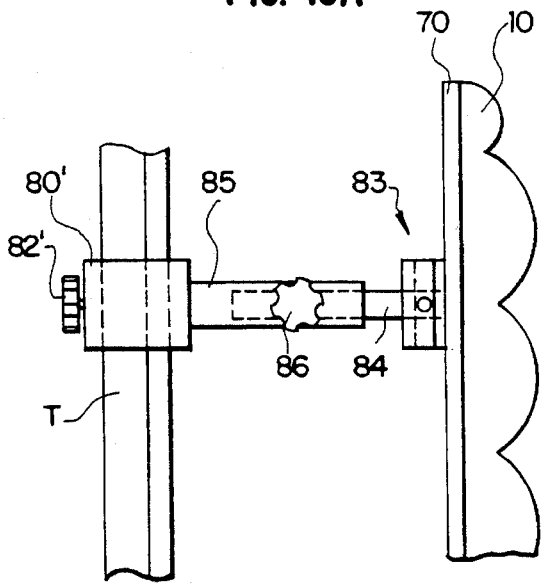
FIG. 13A is a detailed side view of the back support and the mechanism for permitting the back support to move back and forth and tilt.
Figure 13B:
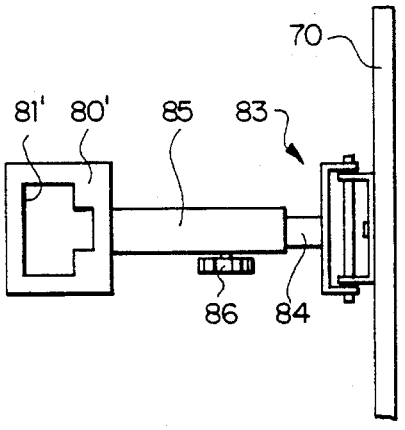
FIG. 13B is a detailed top view of the mechanism for permitting the back support to move back and forth and tilt.

Although the back support 10 is shown as being slidable up and down in FIGS. 1, 2 and 5, the back support 10 may also be constructed for back and forth movement, as well as tiltable movement to provide for further adjustability for the user. In particular, as shown in FIGS. 13A and 13B, the back support 10 may be pivotally mounted as at 83 on a tubular member 84 which in turn is telescopically mounted within a further tubular member 85. The tubular member 85 is stationarily mounted to the support portion 80'. The support portion 80' again includes an opening 81' for slidably fitting over the tower T. Accordingly, the support portion 80', along with the entire back support assembly, is slidably adjustable up and down with respect to the tower T, as well as being adjustable back and forth and pivotable. The telescopic connection between the tubular members 84 and 85 includes a locking knob 86 for locking the back support 10 at the desired forward or backward position. The pivot 83 may also include a locking means (not shown).

As shown in FIG. 5, the upper cushion portion 11 includes a pair of spaced apart, parallel bars 90 and 91 extending downwardly into corresponding openings 92 and 93, respectively, formed within the back support 10. Again, the upper cushion 11 may be slid to a desired height position up or down with respect to the back support 10.

The upper portion 6 of the tower T may include gradation markings or color coded markings to facilitate adjustment of each of the footrest 7, seat 8, armrest bar 9 and back support 10.

A second embodiment of the present invention will now be described in reference to FIGS. 14–18. Many of the structural elements similar to those illustrated for the previous embodiment are designated by the same reference numerals but followed by a prime sign.

Figures 14, 15:
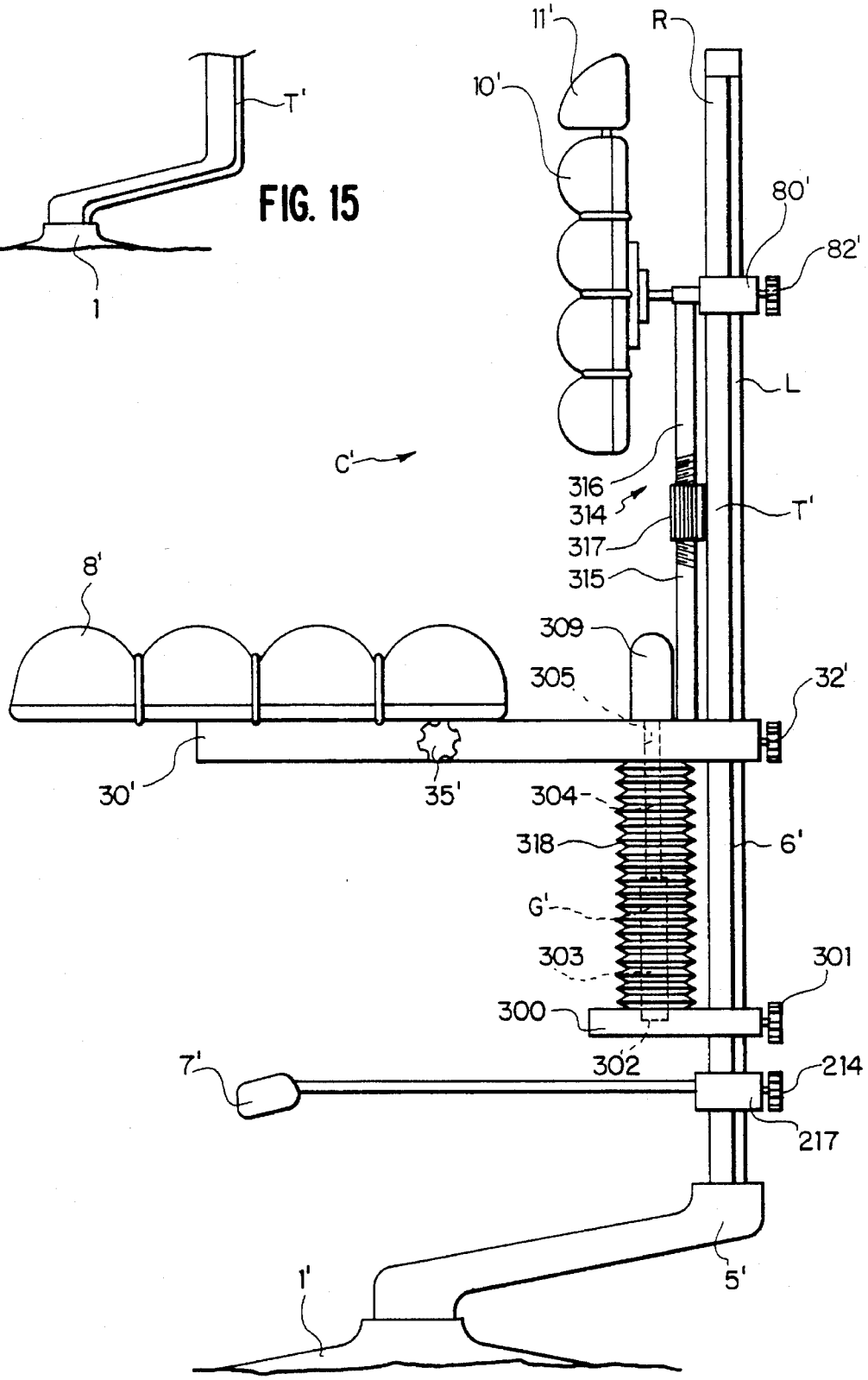
FIG. 14 is a side elevational view of the adjustable, tower chair according to a second embodiment of the present invention.
FIG. 15 is a fragmentary view of an alternative tower design.

FIG. 14 shows a side elevational view of a second embodiment of the present invention which is similar to the first embodiment, but includes several important differences. In particular, in the second embodiment the tower T' having a T-shaped cross section includes the leg portion L of the T-shaped cross section on the back of the tower and the cross bar portion R of the T facing the front of the seat. The cross bar portion R of the T may be a metal piece which is 0.5" thick and, for example, 2.5" wide. The leg portion L of the T may be a separate member which is suitably fastened to the cross bar member R such as by welding or bolting. Of course, the configuration of the tower T' as shown in FIG. 14 can be utilized in the first embodiment of FIGS. 1–13 and vice versa.

While FIG. 14 shows the tower T' having a separate lower portion 5' which is pivotally mounted to the base 1', and an upper portion 6', the tower T' can likewise be formed of a single piece of bent metal stock, such as shown in FIG. 15.

Like the first embodiment, in the second embodiment, the back support, the armrest, the seat, and the footrest are all vertically adjustable up and down along the tower T' (please note that the armrest and the slide and pivot assembly for the seat have been omitted from FIG. 14 to simplify the understanding of the drawing). Moreover, the back support 10' may be slidably and pivotally adjusted, the seat 8' may be slidably and pivotally adjusted, and the footrest 7' may include a telescopic construction as shown in FIG. 6 just as described in detail above with respect to the first embodiment.

However, the second embodiment adds an additional feature of a gas cylinder G' which is mounted on a height adjustable base 300. By mounting the gas cylinder on an adjustable base, the seat 8' of the chair C' is infinitely adjustable in height in a vertical range from as low as 12" from the floor to a stool height of, for example, 32". Such a large adjustable height range was heretofore not possible in the conventional gas cylinder arrangement utilized in office chairs, whereby the gas cylinder is normally mounted in the center of the base of the chair and connects underneath the center portion of the seat of the chair.

The height adjustable base or block 300 for adjustably mounting the gas cylinder G' includes an opening having a complementary shape to the tower T' for slidably fitting over the tower, as well as an actuator handle 301 for locking the adjustable base 300 in a manner identical to the locking mechanism of the footrest 7 described in detail above. In this regard, please note that FIGS. 16 and 17 show two versions of the locking mechanism employed with the tower T' of the second embodiment. Again, these locking mechanisms may be utilized for locking any one of the seat, footrest, back support, armrests, or adjustable base for the gas cylinder.

The adjustable base 300 for the gas cylinder G' also includes an blind bore 302 for fitting the lower portion 303 of the gas cylinder therein and securing the same to the adjustable base 300 by suitable fastening means (not shown). The upper portion 304 of the gas cylinder passes through a circular opening 305 in the rail 30' which slidably mounts the seat. The opening 305 may be reinforced with a tubular piece 306 formed of a high strength material which is press-fitted into the circular opening 305 of the rail 30' (see FIG. 18).

As best shown in FIG. 18, the upper portion 304 of the gas cylinder G' extends through the opening 305 of the rail 30' and slightly above the upper surface of the rail 30'. A rigid cap 307, to which the top of the upper portion 304 of the gas cylinder G' is fixedly connected, is suitably fastened to the rail 30' behind the seat cushion, such as by bolts 308. A finishing bell 309 is placed over the protruding portion 310 of the gas cylinder G' and the rigid cap 307 and is held in place by the same bolts 308 which secure the rigid cap 307 to the rail 30'. The bell 309 includes an opening 311 at a side portion thereof for passing the conventional actuator lever 312 (shown schematically) for opening and closing a button 313 on the top face of the gas cylinder G' for releasing gas within the cylinder, to thereby allow the user to lower the seat height while sitting in the chair. The lever 312 also permits the seat to rise to its maximum height when actuated without the weight of the user on the seat in the conventional manner.

An adjustable bar 314 (see FIG. 14) may also be included between the rail 30' and the back support adjustment mechanism to permit the user to raise and lower the seat 8' and back support 10' together as a unit, thereby obviating the need to adjust the seat and the back support separately once a custom spacing between the two has been chosen by the user. The adjustable bar 314 is split in two pieces 315, 316 and includes a handle member 317 which is threadedly disposed on threads formed on the ends of the two pieces. The threads are formed in the opposite direction to permit the user to bring the back support and the seat closer together or further away within a predetermined distance. Of course, the adjustable bar 314 between the seat and the back support may be dispensed with.

The operation of the sit/stand adjustable, tower chair according to the second embodiment and, in particular, the adjustment of the seat height including the adjustable gas cylinder, will now be discussed.

When a user of the chair wishes to adjust the height of the seat, the locking mechanism handles will first be loosened on both the adjustable base of the gas cylinder and also the rail 30' of the seat to permit the two to move slidably up and down the tower. The adjustable support base 300 for the gas cylinder increases the height range which can be obtained with the conventional gas cylinder per se. Thus, for example, if a very low seat height is desired (i.e., 12" from the floor), the adjustable support 300 for the gas-cylinder will be set at the lowest possible position and then the locking mechanism activated by turning the handle 301 so that the shank portion thereof enters into one of the holes formed on the back of the tower. Then, the user presses the gas release lever 312 extending from the bell 309 in order to permit the gas cylinder G' to raise the rail 30' as well as the seat 8' to its maximum height. The user would then intermittently operate the gas cylinder G' release lever 312 in the conventional way to release the gas and lower the seat 8' until the seat reaches the desired height.

The fact that the rail 30' is mounted on the tower T' simply gives added stability to the seat by serving as a guide means for the rail 30'. Moreover, although the user would not be required to lock the locking mechanism for the rail, if desired the actuator handle 32' could be operated so that the shank portion enters into one of the holes which is spaced apart, for example, by 0.5". Of course, by locking the rail 30' into position, while giving even further stability, this action overrides the action of the gas cylinder G' so that the option of even a finer adjustment between the 0.5" increments permitted by the holes would be eliminated. Alternatively, if the actuator handle 32' on the back of the tower T' is not operated so as to lock the rail along the tower, the gas cylinder G' alone is capable of supporting the weight of the user, while at the same time permitting infinite adjustability of the seat 8' within the minimum and maximum height range of the gas cylinder.

Of course, if the back support 10' is rigidly connected to the rail 30' by means of the adjustable bar 314, then the locking mechanism 80', 82' at the back of the tower would be unlocked so that the back support 10' can slide together with the seat 8'. Once the desired seat height has been obtained, the back support 10' may be finely adjusted by turning the adjustment handle 317 on the adjustable bar 314. Then, with the back support in the desired position, the actuator handle 82' may be actuated so that the shank enters into one of the desired holes on the back of the tower T', or the actuator handle 82' can be left unengaged so that the block or support portion 80' simply acts as a guide means but is not locked in place, again, the weight being held by the gas cylinder G', or a combination of the gas cylinder G' and the locking mechanism of the rail 30'. An optional collapsible accordion guard 318 may be included to surround the gas cylinder G'.

Thus, as is clear from the foregoing discussion, the gas cylinder on the adjustable base according to the second embodiment permits the user to raise or lower the height of the entire gas cylinder thereby dramatically increasing the height range of the standard gas cylinder per se.

The gas cylinder could be replaced by, for example, an electric motor driven screw and nut arrangement.

It is contemplated that numerous modifications may be made to the sit/stand adjustable, tower chair of the present invention without departing from the spirit and scope of the invention as defined in the following claims.

What is claimed is:

1. An adjustable chair comprising:

a base including a central portion and a plurality of radial spokes projecting from said central portion;

a tower including a lower portion comprising a lazy S-shaped member having one downwardly facing end mounted to said central portion of said base and an opposite upwardly facing end, and an upper portion having a lower end joined to said opposite upwardly facing end of said lower portion and extending upwardly with respect to said lower portion, said upper portion thereby being off-center with respect to said central portion of said base; and a seat disposed on said upper portion of said tower and including seat height adjustment means connected between said seat and said tower for movably adjusting said seat up and down on said tower.

2. The adjustable chair according to claim 1, further comprising a back support disposed on said upper portion of said tower and including back support height adjustment means for movably adjusting said back support up and down on said tower.

3. The adjustable chair according to claim 2, wherein said back support comprises a rigid support, a fluid filled pad disposed thereon, and at least one pinching means for pinching said fluid filled pad to form a plurality of pillow sections.

4. The adjustable chair according to claim 3, wherein said pinching means comprises a barrette clip having a rear clip portion which fits behind said rigid support of said back support, and a front movable clip portion which is hinged at one end to an end of said rear clip portion and has a free end which engages with an opposite end of said rear clip portion.

5. The adjustable chair according to claim 3, wherein the fluid of said fluid filled pad comprises silicone gel.

6. The adjustable chair according to claim 3, wherein the fluid of said fluid filled pad comprises air.

7. The adjustable chair according to claim 1, further comprising a footrest disposed on said upper portion of said tower and including footrest height adjustment means for movably adjusting said footrest up and down on said tower.

8. The adjustable chair according to claim 1, further comprising a U-shaped armrest bar disposed on said upper portion of said tower and including armrest height adjustment means for movably adjusting said armrest bar up and down on said tower.

9. The adjustable chair according to claim 1, wherein said seat comprises a rigid support, a fluid filled pad disposed thereon, and at least one pinching means for pinching said fluid filled pad to form a plurality of pillow sections.

10. The adjustable chair according to claim 9, wherein said pinching means comprises a barrette clip having a lower clip portion which fits underneath said rigid support of said seat, and an upper movable clip portion which is hinged at one end to an end of said lower clip portion and has a free end which engages with an opposite end of said lower clip portion.

11. The adjustable chair according to claim 9, wherein said pinching means comprises a stepped surface disposed on an upper surface of said rigid support of said seat, said fluid filled pad being disposed over said stepped surface.

12. The adjustable chair according to claim 9, wherein the fluid of said fluid filled pad comprises silicone gel.

13. The adjustable chair according to claim 9, wherein the fluid of said fluid filled pad comprises air.

14. The adjustable chair according to claim 1, further comprising a gas cylinder having an upper portion and a lower portion, said upper portion of said gas cylinder being fixedly mounted to one of said seat and said seat height adjustment means; and a height adjustable base for mounting thereon said lower portion of said gas cylinder, said height adjustable base being slidably disposed on said upper portion of said tower and including a locking mechanism for locking said height adjustable base at a desired height on said tower, to attendantly increase an adjustable height range of said seat.

15. An adjustable chair comprising:

a base including a central portion;

a tower including a lower portion mounted to said central portion of said base, and an upper portion extending upwardly with respect to said lower portion and off-center with respect to said central portion of said base;

a support rail disposed on said upper portion of said tower and including means for movably guiding said support rail up and down on said tower;

a seat disposed on said support rail and operative to move up and down therewith on said tower;

a gas cylinder, for seat height adjustment, having an upper portion and a lower portion, said upper portion of said gas cylinder being fixedly mounted to said support rail; and a height adjustable base for mounting thereon said lower portion of said gas cylinder, said height adjustable base being slidably disposed on said upper portion of said tower and including a locking mechanism for locking said height adjustable base at a desired height on said tower, to attendantly increase an adjustable height range of said seat.

16. The adjustable chair according to claim 15, further comprising a back support disposed on said upper portion of said tower and including back support height adjustment means connected between said back support and said tower for movably adjusting said back support up and down on said tower; and a footrest disposed on said upper portion of said tower and including footrest height adjustment means connected between said footrest and said tower for movably adjusting said footrest up and down on said tower, such that said seat, said back support, and said footrest are all adjustably mounted on said upper portion of said tower.

17. The adjustable chair according to claim 15, wherein said base further includes a plurality of radial spokes projecting from said central portion.

18. The adjustable chair according to claim 15, wherein said lower portion of said tower comprises a lazy S-shaped member having one downwardly facing end mounted to said central portion of said base and an opposite upwardly facing end which joins a lower end of said upper portion of said tower.

* * * * *